US007757525B2

(12) United States Patent
Pallo

(10) Patent No.: US 7,757,525 B2
(45) Date of Patent: Jul. 20, 2010

(54) DIAL MECHANISM FOR A COMBINATION LOCK

(75) Inventor: R. David Pallo, Fairport, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 225 days.

(21) Appl. No.: 11/814,211

(22) PCT Filed: Jan. 20, 2006

(86) PCT No.: PCT/US2006/002394

§ 371 (c)(1),
(2), (4) Date: Jul. 18, 2007

(87) PCT Pub. No.: WO2006/079050

PCT Pub. Date: Jul. 27, 2006

(65) Prior Publication Data

US 2009/0126427 A1 May 21, 2009

Related U.S. Application Data

(60) Provisional application No. 60/646,062, filed on Jan. 21, 2005.

(51) Int. Cl.
*E05B 1/00* (2006.01)

(52) U.S. Cl. ..... 70/332; 70/22; 70/286; 70/327; 70/445; 74/553; 74/527; 74/528; 74/531

(58) Field of Classification Search ..... 70/22, 70/286, 324, 327, 328, 330–332, 334, 445; 74/527, 528, 531, 553
See application file for complete search history.

(56) References Cited

U.S. PATENT DOCUMENTS

| | | | | |
|---|---|---|---|---|
| 783,210 | A | 2/1905 | Lewis | |
| 2,836,052 | A | 5/1958 | Miller | |
| 3,017,761 | A | 1/1962 | Pleterski | |
| 3,023,602 | A | 3/1962 | Foote et al | |
| 3,050,977 | A * | 8/1962 | Foote et al. | 70/332 |
| 3,273,363 | A * | 9/1966 | North et al. | 70/330 |
| 4,197,726 | A | 4/1980 | Uyeda | |
| 4,404,823 | A | 9/1983 | Miller et al. | |
| 4,541,259 | A * | 9/1985 | Uyeda | 70/330 |
| 4,841,759 | A * | 6/1989 | Balasingam | 70/330 |
| 5,003,802 | A | 4/1991 | Beatty et al. | |
| 2003/0115919 | A1 * | 6/2003 | Haczynski et al. | 70/445 |

* cited by examiner

*Primary Examiner*—Peter M Cuomo
*Assistant Examiner*—Christopher Boswell
(74) *Attorney, Agent, or Firm*—Woods Oviatt Gilman LLP

(57) ABSTRACT

A dial mechanism for a combination lock is provided. The dial mechanism may include an escutcheon plate, a ring member, a fastening member, and a dial. The ring member may include three arms, wherein each of the arms have first and second portions. The first portion extends inwardly from an inner edge of the ring member and the second portion extends perpendicularly from the first portion. The arms include a protrusion that extends outwardly from each of the second portions. The fastening member fixedly mounts the ring member to the escutcheon plate and includes an indicator. A plurality of tick marks are positioned on an outer surface of the dial, and a plurality of teeth extend from an inner surface of the dial. A tick mark is aligned with the indicator when each of the protrusions are positioned between and in contact with two adjacent teeth on the dial.

24 Claims, 5 Drawing Sheets

DIAL MECHANISM FOR A COMBINATION LOCK

CROSS-REFERENCE TO RELATED APPLICATIONS

This application is a National Stage filing under 35 U.S.C. §371 of International Application No. PCT/US2006/02394, filed Jan. 20, 2006, which in turn claims the benefit of U.S. Provisional Application No. 60/646,062, filed Jan. 21, 2005.

BACKGROUND OF THE INVENTION

The present invention relates to a dial mechanism for a combination lock. In particular, the dial mechanism of the present invention operates to align the tick marks on a dial with an indicator. More particularly, the dial mechanism includes a ring member having a plurality of protrusions that are positioned between and in contact with at least two teeth formed in the dial so that the tick marks are aligned with the indicator.

It is known to use a combination lock to secure an interior compartment of a safe. Combination locks typically include a rotatable dial that allows a user to enter a combination of numbers by manually aligning one or more numbered tick marks on the dial with a stationary indicator located on the safe. On some combination dials, the tick marks may be rather small and positioned close together making it difficult to determine if a selected tick mark is properly aligned with the indicator when entering the combination. Therefore, a user must slowly rotate the dial when approaching the desired tick mark to ensure that the correct combination is being entered.

Some combination dials make a clicking sound to alert the user that the dial has been rotated a certain distance. However, these types of combination dials still allow the dial to be rotated a certain distance in between clicks on the dial. In other words, the tick marks on the dial may not be firmly aligned with the indicator each time the dial is clicked, thereby making it difficult for a user to determine which tick mark is aligned with the indicator. As such, an improper combination may be entered by a user using existing combination dials, which may delay access to the interior compartment of the safe.

Accordingly, there exists a need for a dial mechanism that aligns the tick marks on a combination dial with an indicator. The present invention fills these needs as well as other needs.

SUMMARY OF THE INVENTION

In order to overcome the above stated problems and limitations, there is provided a dial mechanism for a combination lock. The dial mechanism operates to align the tick marks on the dial with an indicator and produces a clicking sound when a new tick mark is aligned with the indicator. Thus, the present invention makes it is easier to identify which tick mark is being entered into the combination lock compared to existing combination dial mechanisms.

In particular, the dial mechanism includes an escutcheon plate, a ring member, a fastening member, and a dial. The ring member may include a body and at least three arms, each of the at least three arms having first and second portions. The first portion extends radially inwardly from an inner edge of the ring member and the second portion extends perpendicularly from the first portion. In addition, each of the arms include a protrusion that extends radially outwardly from each of the second portions. The fastening member operates to fixedly mount the ring member to the escutcheon plate. The fastening member may also include an indicator. The dial is rotatably coupled with the ring member and includes an outer surface and an inner surface. The outer surface has a plurality of tick marks thereon, and the inner surface has a plurality of teeth extending around the inner circumference of the dial. One of the tick marks is aligned with the indicator when the protrusions are positioned between and in contact with two adjacent teeth.

Furthermore, the three arms on the ring member may be equally spaced apart from one another to properly balance the dial relative to ring member. Also, the inner edge of the ring member has at least three cut out portions, wherein the at least three arms are positioned within the at least three cut out portions. Moreover, the arms on the ring member may be biased such that the arms snap back between the teeth when the dial is rotated so that the indicator will not have a tendency to be positioned between the ticks marks on the dial.

BRIEF DESCRIPTION OF THE SEVERAL VIEWS OF THE DRAWINGS

The above-mentioned and other features and advantages of this invention, and the manner of attaining them, will become apparent and be better understood by reference to the following description of one embodiment of the invention in conjunction with the accompanying drawings, wherein.

DETAILED DESCRIPTION OF THE INVENTION

Figure 1:
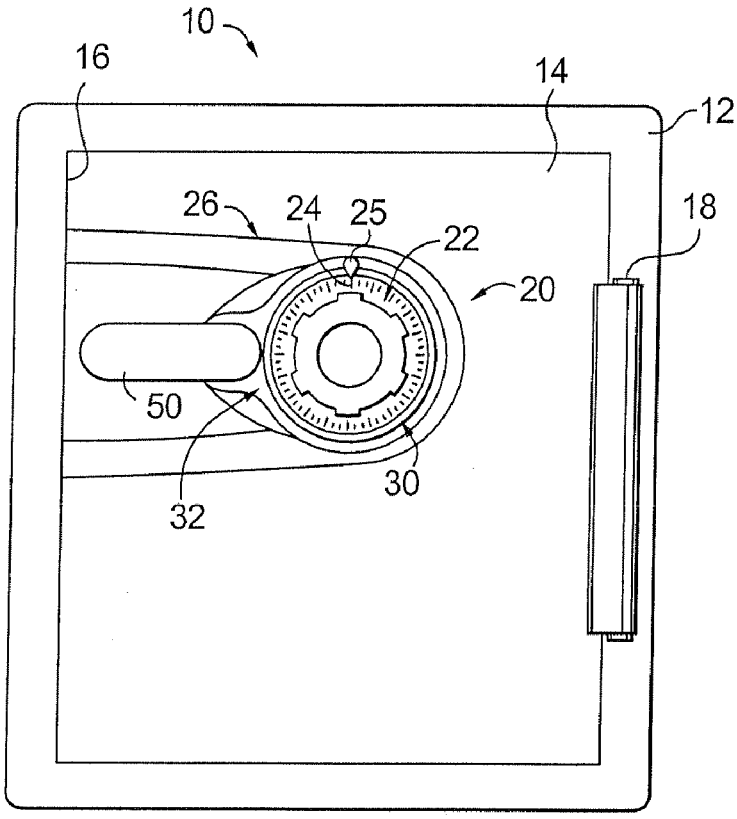
FIG. 1 is a front elevation view of a safe including a dial mechanism in accordance with the present invention.

Referring to the drawings in detail, and particularly FIG. 1, there is shown a safe or enclosure 10 having a housing 12 and a door 14. The housing 12 includes an opening 16 that provides access to an interior compartment defined by housing 12. Door 14 is positioned within opening 16 and is pivotally coupled with housing 12 by a hinge 18. A combination dial mechanism 20 is mounted to door 14 and may be used to selectively allow a user to unlock a combination locking mechanism to provide access to the interior compartment of safe 10. In particular, dial mechanism 20 includes a dial 22 with a plurality of tick marks 24 positioned thereon that may be firmly aligned with an indicator 25 when dial 24 is used to enter a combination to gain access to the interior compartment of safe 10. Furthermore, dial mechanism 20 operates to produce a clicking sound to alert a user that dial 22 has been rotated and that a different tick mark 24 is aligned with indicator 25.

Figure 2:
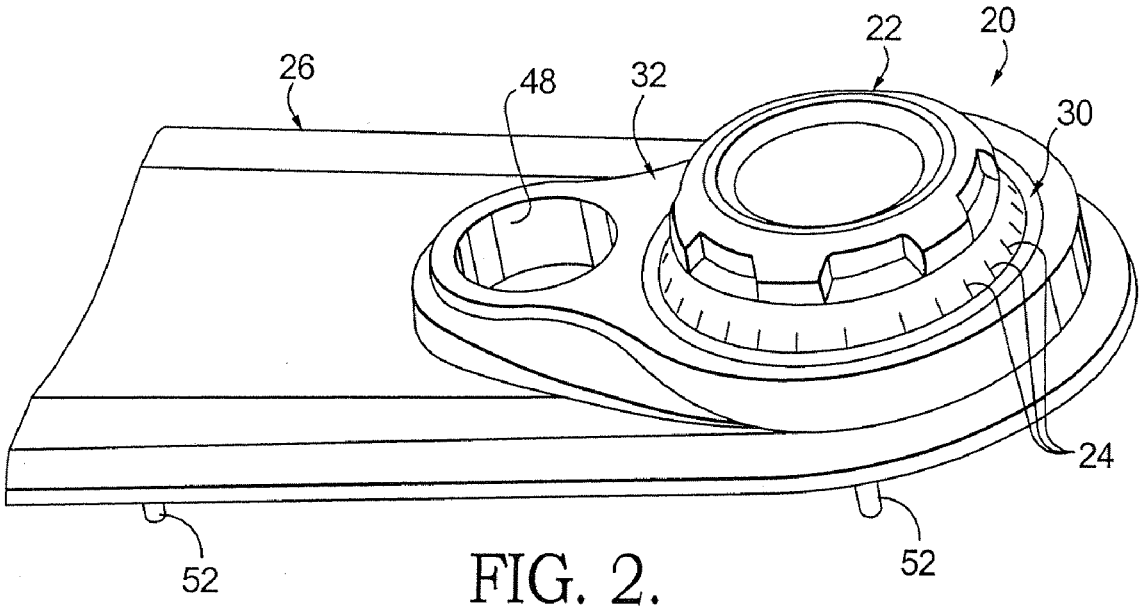
FIG. 2 is a front perspective view of the dial mechanism shown in FIG. 1.
Figure 3:
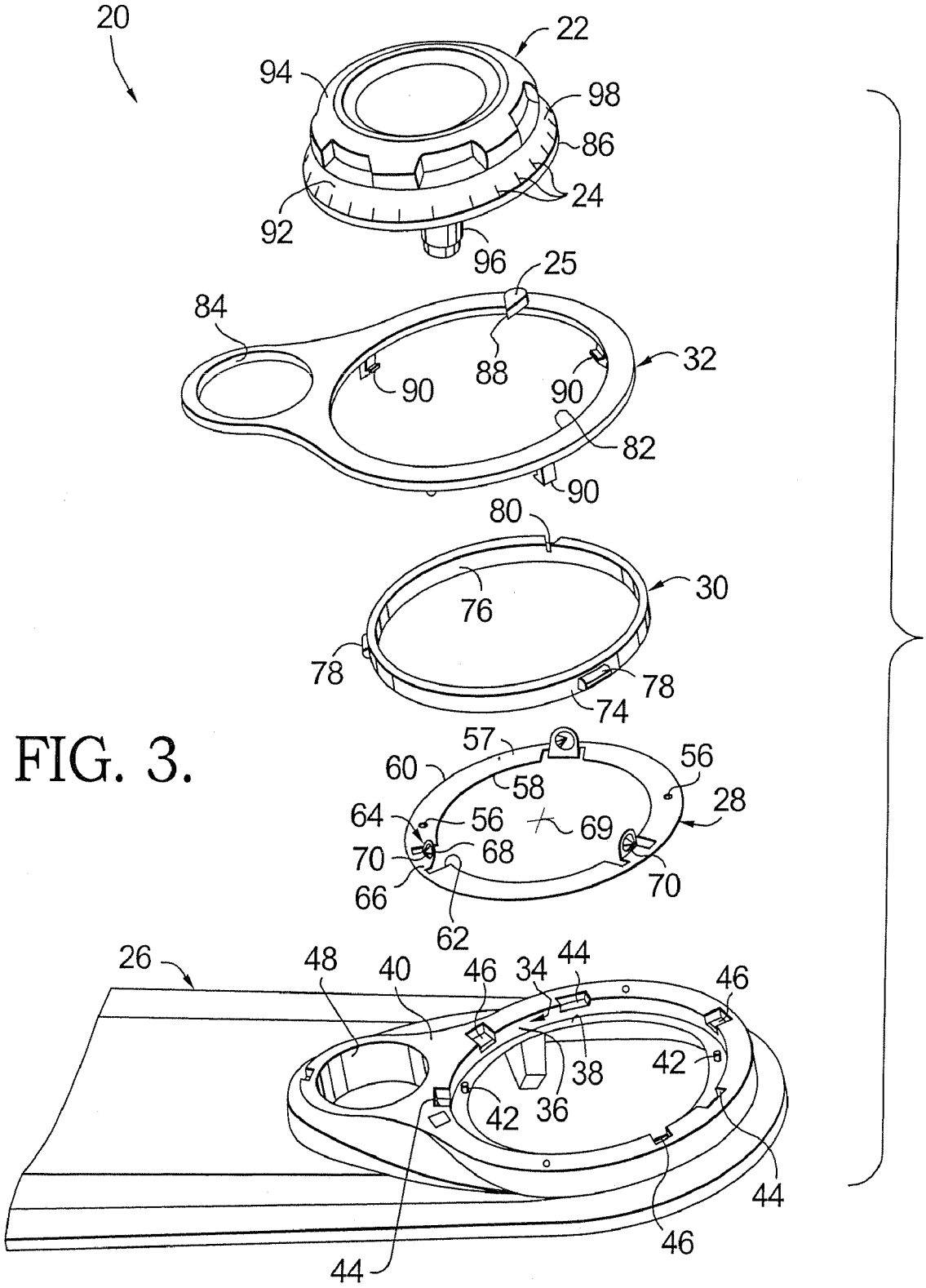
FIG. 3 is an exploded view of the dial mechanism shown in FIG. 2.
Figure 4:
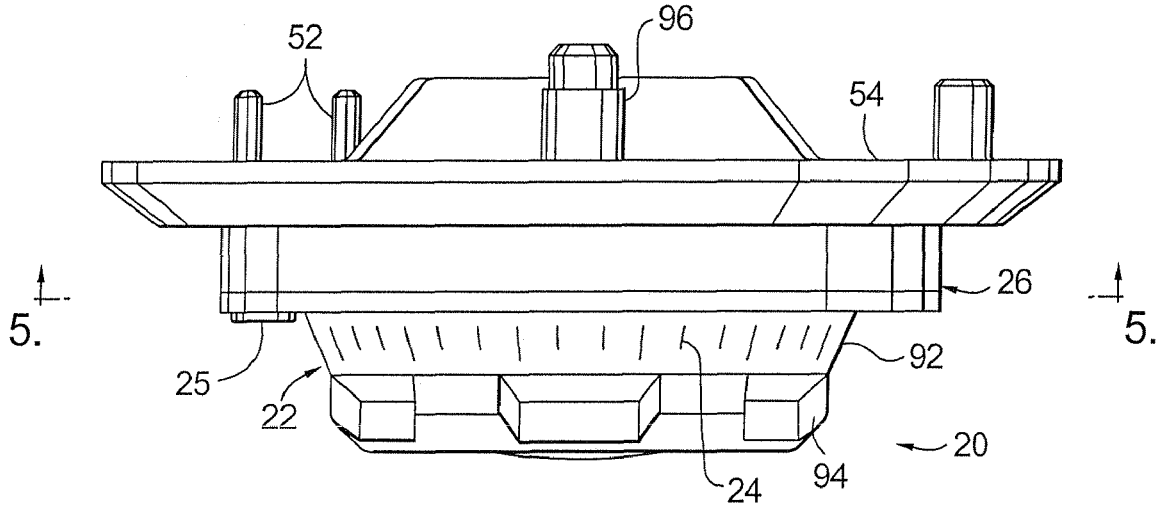
FIG. 4 is a right side view of the dial mechanism shown in FIG. 2.

As best seen in FIGS. 2 and 3, dial mechanism 20 includes an escutcheon plate 26, a base or ring member 28, a trim ring 30, a fastening member 32, and dial 22. In particular, as best seen in FIG. 3, escutcheon plate 26 includes an aperture 34 defined therein adapted to accept ring member 28 and trim ring 30. Aperture 34 may be generally circular and include an inner wall 36 and a ledge 38. Inner wall 36 of aperture 34 may extend downwardly, and preferably perpendicularly, from an outer surface 40 of escutcheon plate 26. Further, ledge 38 may extend radially inwardly, and preferably perpendicularly, from inner wall 36. One or more posts 42 may be positioned on ledge 38 to assist in properly aligning ring member 28 on ledge 38. Escutcheon plate 26 may also have one or more alignment grooves 44 and snap openings 46 defined therein. Alignment grooves 44 are used to properly align trim ring 30 within aperture 34, and snap openings 46 provide a location for fastening member 32 to engage escutcheon plate 26. Further, escutcheon plate 26 may include a handle aperture 48 that is adapted to accept a handle 50, as best seen in FIG. 1. As best seen in FIG. 4, a plurality of posts 52 that extend outwardly from a back surface 54 of escutcheon plate 20 so that escutcheon plate 26 may be mounted to door 14 of safe 10.

Figure 8:
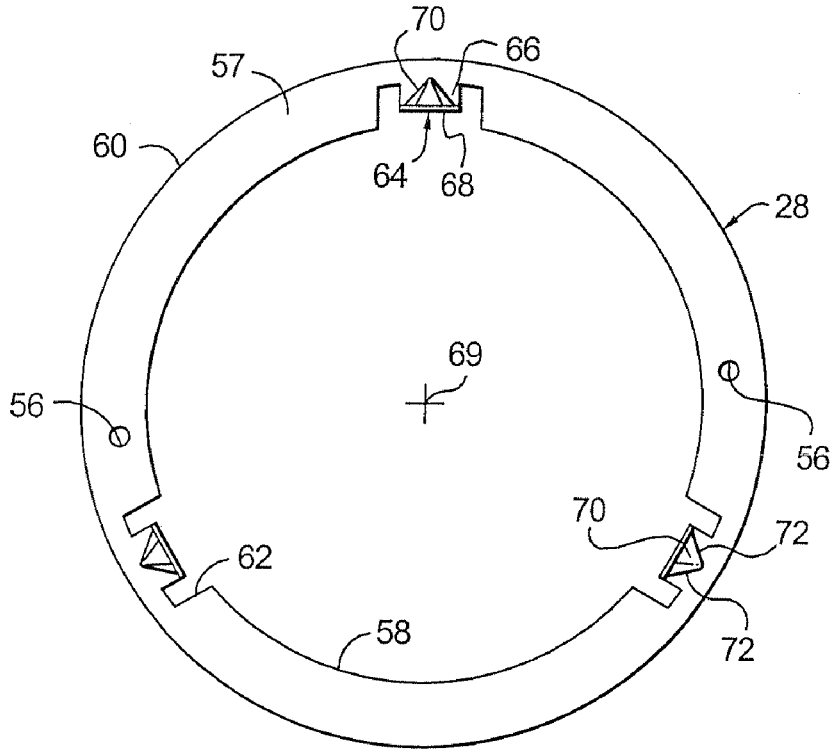
FIG. 8 is a top view of a ring member that is used in the dial mechanism shown in FIG. 3.

As best seen in FIGS. 3 and 8, ring member 28 may be generally flat and adapted to fit within aperture 34 and be supported by ledge 38. One or more apertures 56 may be formed in a body 57 of ring member 28 and be positioned to accept posts 52 for properly aligning ring member 28 on ledge 38. Also, ring member 28 may include an inner edge 58 and an outer edge 60. Outer edge 60 is adapted to fit within the aperture 34 formed in escutcheon plate 26. Inner edge 58 may be circular and have three cut out portions 62 defined therein. Each cut out portion 62 may have an arm 64 positioned therein, wherein each arm 64 includes a first portion 66 and a second portion 68. First portion 66 extends radially inwardly from inner edge 58 of cut out portion 62 toward a center 69 of ring member 28 in generally the same plane as body 57. Second portion 68 may extend perpendicularly from first portion 66. Thus, arm 64 is generally an L-shaped member positioned within cut out portion 62 and coupled with body 57. Due to the shape of arm 64 and the relatively flat profile of the ring member 28, arm 64 may flex or bend relative to body 57 when a force is applied to second portion 68 of arm 64.

Figure 9:
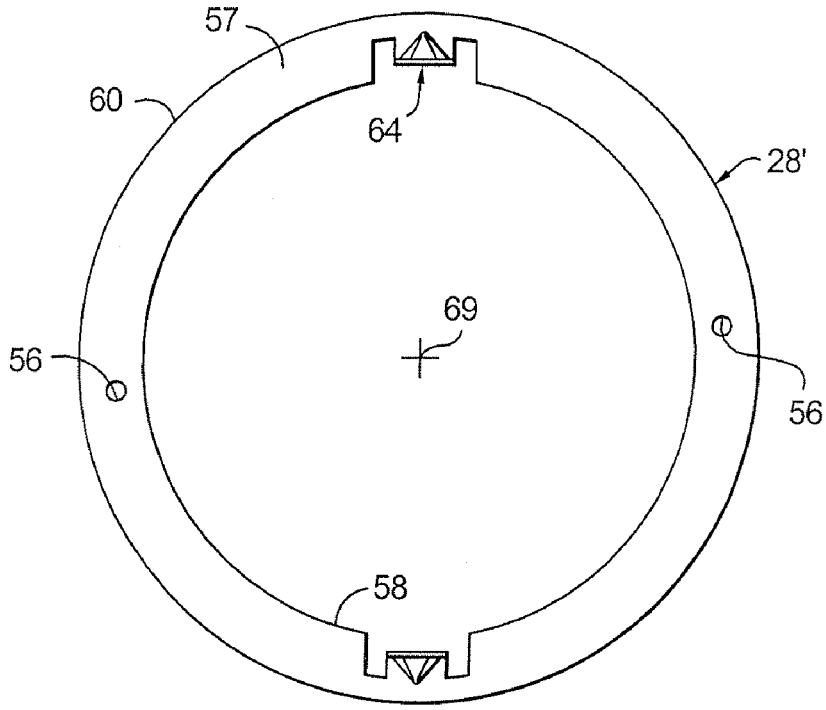
FIG. 9 is an alternative embodiment of the ring member shown in FIG. 8.

In addition, as best seen in FIGS. 3, 5, 6 and 8, second portion 68 may include a protrusion or boss 70 that extends or protrudes outwardly from second portion 68 and generally away from center 69. In addition, protrusion 70 includes contact surfaces 72 that are adapted to contact dial 22, which will be discussed in more detail below. Protrusions 70 may be cone-shaped, semi-spherical or any other shape that will allow protrusion 70 to be positioned between and in contact with adjacent teeth 100 on dial 22. The present invention may include three arms 64 that contact dial 22 to equally distribute the force imposed on dial 22 by arms 64 thereby properly balancing dial 22 relative to ring member 28. However, as best seen in FIG. 9, it is also within the scope of the present invention to use a ring member 28' including two arms 64 having two protrusions 70 in contact with dial 22. Furthermore, it will be understood that the ring member may include only one arm or more than three arms each having a protrusion in contact with the dial.

Figure 5:
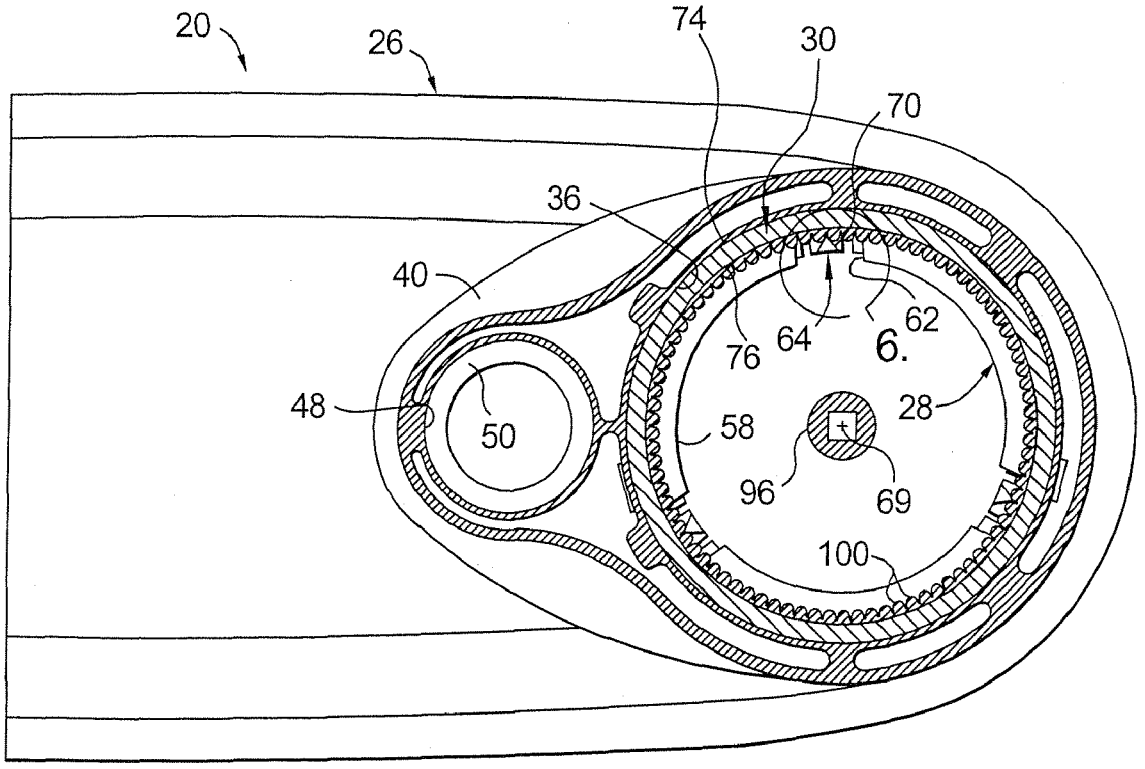
FIG. 5 is a cross-sectional view taken along line 5-5 in FIG. 4.

As best seen in FIGS. 3 and 5, trim ring 30 is generally ring-shaped and adapted to fit within aperture 34 formed in escutcheon plate 26. Specifically, trim ring 30 includes an outer surface 74 and an inner surface 76. Outer surface 74 may include a plurality of alignment flanges 78 that are adapted to fit within alignment grooves 44 defined in escutcheon plate 26 for properly aligning trim ring 30 in aperture 34. With specific reference to FIG. 5, outer surface 74 may also be adapted to contact inner wall 36 of aperture 34, and inner surface 76 is positioned at a location between inner wall 36 and protrusions 70 to allow dial 22 to come into contact with protrusion 70. As best seen in FIG. 3, an indicator recess 80 is defined in trim ring 30 and operates to accept and properly position indicator 25 relative to escutcheon plate 26.

Fastening member 32 operates to fixedly mount and retain ring member 28 and trim ring 30 to escutcheon plate 26. As best seen in FIG. 3, fastening member 32 includes a main opening 82 adapted to allow dial 22 to be positioned therein and trim ring 30 to be exposed. A handle aperture 84 is defined therein and adapted to match handle aperture 48 defined in escutcheon plate 26. Indicator 25 is mounted to fastening member 32 and positioned so that it is adjacent to an outer circumference 86 of dial 22. In particular, indicator 25 includes a point 88 that is aligned with the tick marks 24 on dial 22. Fastening member 32 may also include a plurality of snap arms 90 that may be inserted into snap openings 46 defined in escutcheon plate 26 to securely fasten fastening member 32 to escutcheon plate 26.

Figure 7:
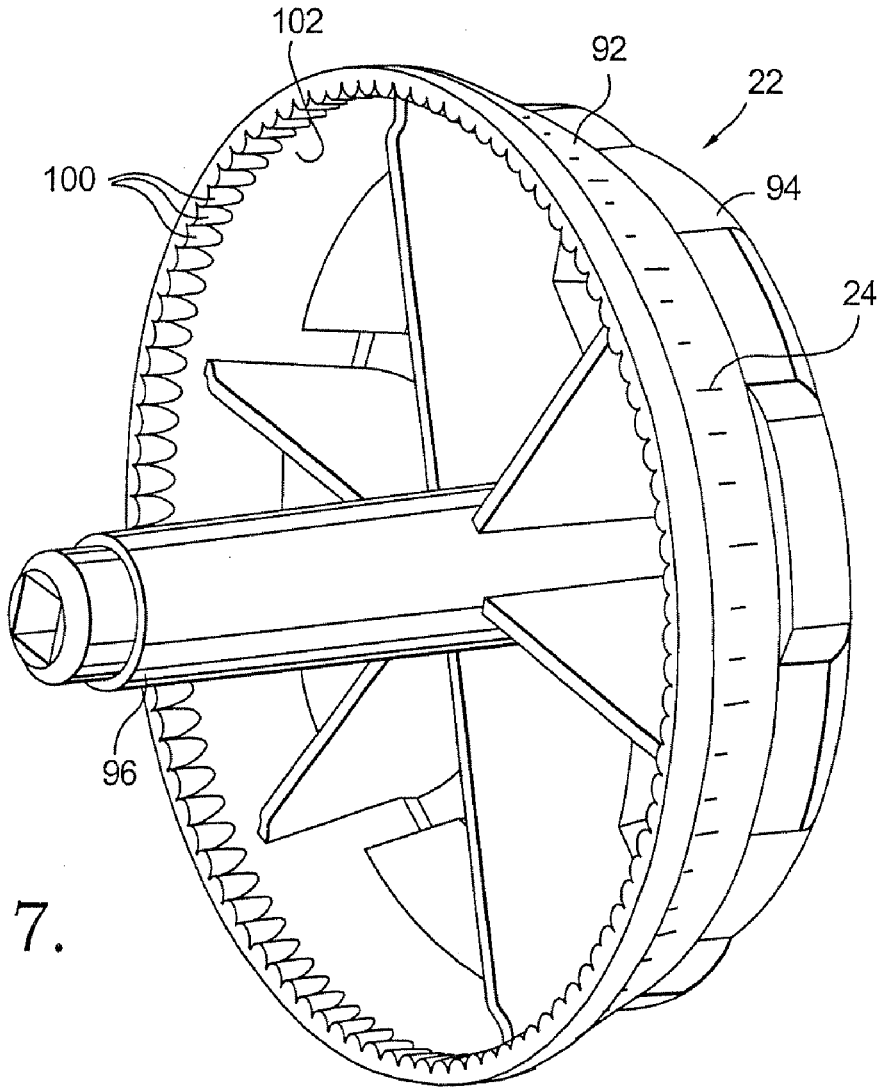
FIG. 7 is a rear perspective view of a dial that is used in the dial mechanism shown in FIG. 3.

As best seen in FIGS. 3, 4 and 7, dial 22 includes a base 92, a grip portion 94 positioned on base 92, and a spindle 96 that extends from base 92. Base 92 is adapted to fit within main opening 82 of fastening member 32. Tick marks 24 may be positioned on an outer surface 98 and adjacent to outer circumference 86 of base 92. Each of the tick marks 24 may generally represent a numerical value that enables a user to enter a combination in order to unlock safe 10. Tick marks 24 are generally located around the entire outer circumference 86, but it will be understood that tick marks 24 may only be positioned around a portion of outer circumference 86. Furthermore, tick marks 24 may take the form of a line, dot or other type of marking on dial 22 that will enable a user to enter a combination.

Figure 6:
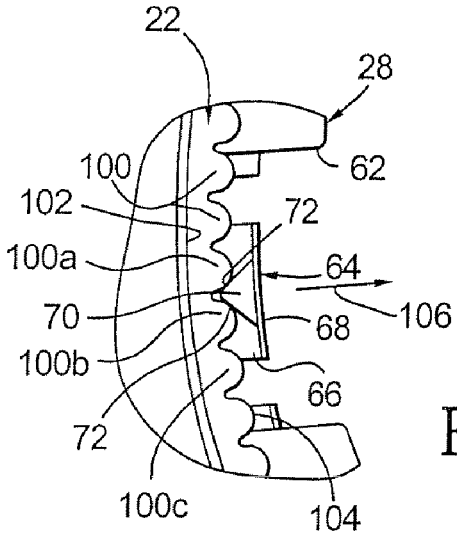
FIG. 6 is an enlarged view of a portion of the cross-sectional view in FIG. 5 designated by the number "6"

Furthermore, as best seen in FIGS. 5-7, a plurality of teeth or ridges 100 extend radially inward from an inner surface 102 of dial 22. One or more of teeth 100 may be distributed about the entire, or a portion of, the inner surface 102, each having a generally rounded end 104. At least a portion of the contact surfaces 72 of protrusion 70 formed in ring member 28 are adapted to be positioned between and in contact with adjacent teeth 100*a*, 100*b*, as best seen in FIG. 6.

As best seen in FIGS. 3, 4 and 7, spindle 96 extends outwardly from back surface 54 of dial 22 and is coupled with a combination locking mechanism so that dial 22 may rotate relative to escutcheon plate 26, ring member 28, trim ring 30 and fastening member 32. The combination locking mechanism operates to allow a user to open door 14 using handle 50 if the correct combination of tick marks 24 are aligned with indicator 25 using dial 22 in the correct sequence. For instance, the locking mechanism shown and described in U.S. Pat. No. 6,131,428 to Wildman, which is hereby incorporated by reference, may be coupled with spindle 96 to lock the safe 10.

In assembling dial mechanism 20, ring member 28 is placed in aperture 34 formed in escutcheon plate 26 so that body 57 of ring member 28 is supported on ledge 38. Further, ring member 28 may be properly positioned on ledge 38 by inserting posts 42 into apertures 56 formed in ring member 28. Next, trim ring 30 is placed within aperture 34 and on top of ring member 28 so that alignment flanges 78 are positioned within alignment grooves 44 formed in escutcheon plate 28. Fastening member 32 is then positioned on outer surface 40 of escutcheon plate 28 so that snap arms 90 are inserted within snap openings 46 formed in escutcheon plate 28. As snap arms 90 are inserted into snap openings 46, indicator 25 is received within indicator recess 80 formed in trim ring 30. Fastening member 32 is securely mounted to escutcheon plate 26 and positioned over the alignment grooves 44 so that trim ring 30 and ring member 28 are secured to escutcheon plate 28. As best seen in FIGS. 5 and 6, dial 22 is then positioned within the main opening 82 of fastening ring 32 so that teeth 100 are positioned between trim ring 30 and arms 64 on ring member 28. Furthermore, at least a portion of each contact surface 72 of the protrusions 70 are positioned between and in contact with teeth 100*a*, 100*b* on dial 22. At this point, one of the tick marks 24 on dial 22 is aligned with point 88 on indicator 25 as best seen in FIG. 1. Escutcheon plate 26 may then be mounted to door 14 of safe 10 using posts 52, and spindle 96 may be connected to the combination locking mechanism.

In operation, dial mechanism 20 may be used to enter a combination, unlock the locking mechanism, and access the interior compartment of safe 10. In order to enter a combination, the user rotates the dial 22 to align the tick marks 24 that correspond to the numbers in the combination with indicator 25. As best seen in FIG. 6, at least a portion of contact surfaces 72 on each protrusion 70 are positioned between and in contact with a pair of adjacent teeth 100*a*, 100*b* on dial 22 before dial 22 is rotated. In this position, one of the tick marks 24 is aligned with indicator 25. As dial 22 is rotated relative to ring member 28, protrusion 70 remains in contact with one of teeth 100*b* and rides up the rounded end 104 of the tooth 100*b*, thereby causing arm 64 to flex or bend radially inward in a direction 106. Arm 64 continues to flex or bend radially inward until protrusion 70 reaches the apex of tooth 100*b*. After moving past the apex of tooth 100, arm 64 will snap back so that contact surfaces 72 of protrusion 70 are positioned between and in contact with an adjacent pair of teeth 100*b*, 100*c*. Once protrusion 70 is positioned between teeth 100*b*, 100*c*, a tick mark 24 corresponding to another number will be aligned with indicator 25. The dial 22 may be rotated in this fashion until the desired tick mark 24 is aligned with indicator 25.

Each time arm 64 is positioned between a new set of teeth 100, a clicking sound will be produced by the snapping action of arms 62 moving from the apex of a tooth to a position where protrusion 70 is between and in contact with a pair of adjacent teeth 100. The clicking sound may operate to inform a user that a different tick mark 24 is aligned with indicator 25. It will be understood that arms 64 may be positioned equidistantly from one another about ring member 28 to balance dial 22 by equally distributing the force imposed on dial 22 by arms 64.

Protrusions 70 and teeth 100 are arranged such that each time contact surfaces 72 on the protrusions 70 are positioned between and in contact with teeth 100, a tick mark 24 on dial 22 is aligned with point 88 on indicator 25. By positioning protrusions 70 between and in contact with teeth 100, the dial 22 will not have a tendency to remain in a position where indicator 25 is pointing between tick marks. Instead, the arms 64 are biased so that they have a tendency to be positioned between teeth and therefore align a tick mark 24 with indicator 25. Therefore, dial mechanism 20 reduces the possibility that a user will misread or be unable to determine which tick mark 24 is aligned with indicator 25.

The present invention overcomes and ameliorates the drawbacks and deficiencies in the prior art. For instance, the dial mechanism of the present invention includes a dial and ring member that operates to align the tick marks on the dial with an indicator. Further, the dial and ring member are rotatably coupled with one another so that the dial makes a clicking sound to alert a user each time a different tick mark is aligned with the indicator. By aligning the tick marks on the dial with the indicator and producing a clicking sound when a new tick mark is aligned with the indicator, it is easier to identify which tick mark is being entered into the combination lock compared to existing combination dial mechanisms. Thus, the present invention could reduce the chance that an incorrect combination is entered and reduce the time it takes to access the interior compartment of the safe.

Although the present invention has been described in considerable detail with reference to certain preferred versions thereof, other versions are possible. Therefore, the spirit and scope of the appended claims should not be limited to the description of the preferred versions contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A dial mechanism for a combination lock, the dial mechanism comprising:

a ring member including a body, an arm having first and second portions, and a protrusion, wherein the first portion extends inwardly from an inner edge of the ring member and the second portion extends perpendicularly from the first portion, and wherein the protrusion extends outwardly from the second portion; and a dial including an inner surface, the dial rotatably coupled with the ring member, the dial including at least two teeth extending from the inner surface, wherein at least a portion of the protrusion is positioned between and in contact with the at least two teeth.

2. The dial mechanism recited in claim 1, wherein the inner edge of the ring member has a cut out portion defined therein, wherein the arm is positioned within the cut out portion.

3. The dial mechanism recited in claim 1, wherein the ring member includes means for flexing the arm relative to the body.

4. The dial mechanism recited in claim 1, further comprising:

an escutcheon plate; and a fastening member having an indicator, wherein the fastening member fixedly mounts the ring member to the escutcheon plate.

5. The dial mechanism recited in claim 4, wherein the dial includes an outer surface having a tick mark thereon, wherein the tick mark is aligned with the indicator when the protrusion is positioned between and in contact with the at least two teeth.

6. The dial mechanism recited in claim 1, wherein the protrusion is semi-spherical.

7. A dial mechanism for a combination lock, the dial mechanism comprising:

an escutcheon plate;

a base member including a protrusion;

a fastening member having an indicator, wherein the fastening member fixedly mounts the base member to the escutcheon plate;

a trim ring, wherein at least a portion of the trim ring is positioned between the fastening member and the base member; and a dial rotatably coupled with the base member, the dial including at least two teeth extending therefrom, the dial including an outer surface having a tick mark thereon, wherein at least a portion of the protrusion is positioned between and in contact with the at least two teeth, wherein the tick mark is aligned with the indicator when the protrusion is positioned between and in contact with the at least two teeth.

8. The dial mechanism recited in claim 7, wherein the dial includes an inner surface, wherein the at least two teeth extend from the inner surface.

9. The dial mechanism recited in claim 8, wherein the base member is a ring.

10. A dial mechanism for a combination lock, the dial mechanism comprising:

a ring member including a body, at least two arms, a first protrusion and a second protrusion, the first and second protrusions being spaced apart from one another, each of the at least two arms having first and second portions, wherein the first portion extends radially inward from an inner edge of the ring member and the second portion extends perpendicularly from the first portion, wherein the first protrusion extends outwardly from one of the second portions, and wherein the second protrusion extends outwardly from another of the second portions; and a dial including an inner surface, the dial rotatably coupled with the ring member, the dial including a plurality of teeth extending from the inner surface, wherein at least a portion of the first protrusion is positioned between and in contact with two of the plurality of teeth, and wherein at least a portion of the second protrusion is positioned between and in contact with another two of the plurality of the teeth.

11. The dial mechanism recited in claim 10, wherein the first and second protrusions are equally spaced apart from one another.

12. The dial mechanism recited in claim 10, wherein the inner edge of the ring member has at least two cut out portions, wherein the at least two arms are positioned within the at least two cut out portions.

13. The dial mechanism recited in claim 10, wherein the ring member includes means for flexing the at least two arms relative to the body.

14. The dial mechanism recited in claim 10, further comprising:

an escutcheon plate; and a fastening member having an indicator, wherein the fastening member fixedly mounts the ring member to the escutcheon plate.

15. The dial mechanism recited in claim 14, wherein the dial includes an outer surface having a tick mark thereon, wherein the tick mark is aligned with the indicator when the first protrusion is positioned between and in contact with the two of the plurality of teeth, and wherein the tick mark is aligned with the indicator when the second protrusion is positioned between and in contact with the other two of the plurality of the teeth.

16. The dial mechanism recited in claim 10, wherein at least one of the first and second protrusions is semi-spherical.

17. A dial mechanism for a combination lock, the dial mechanism comprising:

an escutcheon plate;

a ring member including a first protrusion and a second protrusion, the first and second protrusions being spaced apart from one another;

a fastening member having an indicator, wherein the fastening member fixedly mounts the ring member to the escutcheon plate;

a trim ring, wherein at least a portion of the trim ring is positioned between the fastening member and the ring member; and a dial rotatable coupled with the ring member, the dial including a plurality of teeth extending therefrom, the dial including an outer surface having a tick mark thereon, wherein at least a portion of the first protrusion is positioned between and in contact with two of the plurality of teeth, wherein at least a portion of the second protrusion is positioned between and in contact with another two of the plurality of the teeth, wherein the tick mark is aligned with the indicator when the first protrusion is positioned between and in contact with the two of the plurality of teeth, and wherein the tick mark is aligned with the indicator when the second protrusion is positioned between and in contact with the other two of the plurality of the teeth.

18. The dial mechanism recited in claim 17, wherein the dial includes an inner surface, wherein the plurality of teeth extend radially inward from the inner surface.

19. A dial mechanism for a combination lock, the dial mechanism comprising:

an escutcheon plate;

a ring member including a body and at least three arms, each of the at least three arms having first and second portions, the first portion extending radially inward from an inner edge of the ring member and the second portion extending perpendicularly from the first portion, each of the arms including a protrusion that extends outwardly from each of the second portions;

a fastening member fixedly mounting the ring member to the escutcheon plate, the fastening member having an indicator; and a dial rotatably coupled with the ring member, the dial including an outer surface and an inner surface, the outer surface having a plurality of tick marks thereon, the inner surface having a plurality of teeth extending radially inward therefrom, wherein the tick mark is aligned with the indicator when each of the protrusions are positioned between and in contact with two adjacent teeth on the dial.

20. The dial mechanism recited in claim 19, wherein the at least three arms are equally spaced apart from one another.

21. The dial mechanism recited in claim 19, wherein the inner edge of the ring member has at least three cut out portions, wherein the at least three arms are positioned within the at least three cut out portions.

22. The dial mechanism recited in claim 19, wherein the ring member includes means for flexing the at least three arms relative to the body.

23. The dial mechanism recited in claim 19, further comprising a trim ring, wherein at least a portion of the trim ring is positioned between the fastening member and the ring member.

24. The dial mechanism recited in claim 19, wherein at least one of the protrusions is semi-spherical.

* * * * *